US007907886B2

(12) United States Patent
Katsura et al.

(10) Patent No.: US 7,907,886 B2
(45) Date of Patent: Mar. 15, 2011

(54) IMAGE FORMING APPARATUS

(75) Inventors: Norichika Katsura, Nara (JP); Tadasu Taniguchi, Nara (JP); Masaharu Kimura, Osaka (JP); Masahiko Fujita, Nara (JP); Yasuhiro Takai, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 738 days.

(21) Appl. No.: 11/775,025

(22) Filed: Jul. 9, 2007

(65) Prior Publication Data

US 2008/0008507 A1 Jan. 10, 2008

(30) Foreign Application Priority Data

Jul. 10, 2006 (JP) ..... 2006-189199

(51) Int. Cl.
*G03G 15/00* (2006.01)
*B65H 3/24* (2006.01)
*B65H 3/06* (2006.01)

(52) U.S. Cl. ..... 399/389; 271/142; 271/117

(58) Field of Classification Search ..... 271/142, 271/117
See application file for complete search history.

(56) References Cited

U.S. PATENT DOCUMENTS

| | | | | |
|---|---|---|---|---|
| 6,079,708 | A * | 6/2000 | Fujita | 271/242 |
| 6,299,157 | B1 | 10/2001 | Lim | |
| 2003/0015836 | A1 * | 1/2003 | Westcott et al. | 271/152 |
| 2005/0023745 | A1 * | 2/2005 | Morimoto et al. | 271/117 |

FOREIGN PATENT DOCUMENTS

| | | | |
|---|---|---|---|
| JP | 10-81422 | A | 3/1998 |
| JP | 10-129856 | A | 5/1998 |
| JP | 2000-233838 | A | 8/2000 |
| JP | 2001-294333 | A | 10/2001 |
| JP | 2001294333 | A * | 10/2001 |
| JP | 2004-307183 | A | 11/2004 |

* cited by examiner

*Primary Examiner* — Daniel J Colilla
*Assistant Examiner* — Allister Primo
(74) *Attorney, Agent, or Firm* — Birch, Stewart, Kolasch & Birch, LLP

(57) ABSTRACT

An image forming apparatus comprising: a main body having an image forming section; a sheet feed section having a sheet cassette that accommodates a recording sheet and can be drawn out and loaded to the main body; and a sheet misalignment preventing mechanism that intermittently comes into contact with an uppermost recording sheet in the sheet cassette so as to prevent misalignment of the recording sheet in a loading direction when the sheet cassette drawn out of the main body is reloaded.

3 Claims, 7 Drawing Sheets

IMAGE FORMING APPARATUS

CROSS-REFERENCE TO RELATED APPLICATION

This application is related to Japanese Patent Application No. 2006-189199 filed on Jul. 10, 2006 whose priority is claimed under 35 USC §119 and the disclosure of which is incorporated by reference in its entirety.

BACKGROUND OF THE INVENTION

1. Field of the Invention

The present invention relates to an image forming apparatus, and more particularly to an image forming apparatus capable of high-speed printing, which accommodates a large amount of recording sheets at a front-access type sheet feed portion.

2. Description of the Related Art

Recently, with a view to make an apparatus compact in order to reduce the occupied area thereof, an image forming apparatus provided with a front-access type sheet feed portion is under development (see Japanese Unexamined Patent Application No. 10-129856). A front-access type image forming apparatus includes a document reading section (scanner portion) arranged at an upper portion, an operation section arranged at a front of the document reading section, an image forming section arranged at a below the document reading section, and a sheet feed section having a sheet cassette, which accommodates recording sheets necessary for printing, and arranged at a lowermost part for transporting the sheet one by one to the image forming section, for example. In the image forming apparatus of this type, a sheet is accommodated and replenished with the sheet cassette drawn out of the apparatus, and after the replenishment is finished, the sheet cassette is pushed into the apparatus to be reloaded. A sheet placing plate is provided at a bottom part of the sheet cassette. An upward movement of the sheet placing plate raises an uppermost sheet to a sheet feeding point, and a pickup roller is lowered to the sheet feeding point from an upper stand-by position for transporting the sheet one by one to the image forming section by the pickup roller.

In some of the front-access type image forming apparatuses, a separation pawl (regulating member) for regulating a stacking amount and an uppermost surface of the accommodated sheets is provided at an end edge of the sheet cassette at the downstream side in a sheet transporting direction (see Japanese Unexamined Patent Application No. 2004-307183).

For the high-speed printing of the image forming apparatus, a sheet feed section with a larger capacity is now being developed. In order to provide a large capacity to the sheet feed section, since it is not acceptable to raise the positions of the document reading section and the operation section because this causes an inconvenience for a user, it is necessary to devise a way for accommodating many sheets as possible in the sheet cassette. For example, it is considered that the regulation member provided at the conventional sheet cassette is removed so that the sheets can be accommodated to a full height that is generally equal to the height of the sheet cassette, specifically the sheets can be accommodated up to the top height of a side plate that regulates a sheet setting area provided at a bottom part of the sheet cassette.

However, when the sheets S are fully replenished to the sheet cassette 211 drawn out of a main body 200 of the apparatus and the sheet cassette 211 is pushed strongly to be reloaded into the main body 200 with the regulating member for regulating the uppermost surface of the sheets eliminated as shown in FIG. 7A, the uppermost sheet S might lifts up to run on to the side plate 212 as shown in FIG. 7B. In this case, misalignment in printing or jam during transportation occur due to skew conveyance. Notably, reference numeral 220 denotes a pickup roller in FIG. 7.

As a measure to prevent the misalignment of the sheet described above, it is considered that, during the loading process of the sheet cassette, the pickup roller is moved down to press the uppermost sheet. In this case, it is necessary that a stack of sheets is moved up so that the uppermost surface of the sheet is brought to a position (e.g., sheet feeding point) higher than the sheet cassette and the side plate, so as to prevent the descending pickup roller from contacting the sheet cassette. However, this method entails problems as described below. That is, the sheet pressed by the pickup roller may be damaged or wrinkled, resulting in degradation of image quality caused by printing performed on the damaged sheet, or the movement of the sheets positioned at a position higher than the side plate is stopped before completion of the loading to cause misalignment with respect to the sheet cassette, thereby producing a misalignment in printing.

SUMMARY OF THE INVENTION

The present invention aims to solve these problems, and to provide an image forming apparatus that can accommodate a larger amount of recording sheets without increasing the size of the apparatus.

The present invention provides an image forming apparatus comprising: a main body having an image forming section; a sheet feed section having a sheet cassette that accommodates a recording sheet and can be drawn out and loaded to the main body; and a sheet misalignment preventing mechanism that intermittently comes in contact with an uppermost recording sheet in the sheet cassette so as to prevent misalignment of the recording sheet in a loading direction when the sheet cassette drawn out of the main body is reloaded.

According to the present invention, a larger amount of recording sheets can be accommodated in the sheet cassette without increasing the size of the image forming apparatus and without conducting a drastic change in design, and further, the sheet cassette into which recording sheets are replenished can be reloaded to the main body without causing sheet misalignment and a damage or wrinkle on the recording sheet (without producing factors of skew conveyance, jam during conveyance, deterioration in image quality, etc.). Accordingly, the present invention is preferable for an image forming apparatus capable of high-speed printing (e.g., more than 100 sheets per one minute) that requires accommodation of a large number of sheets.

DESCRIPTION OF THE PREFERRED EMBODIMENTS

Figure 1:
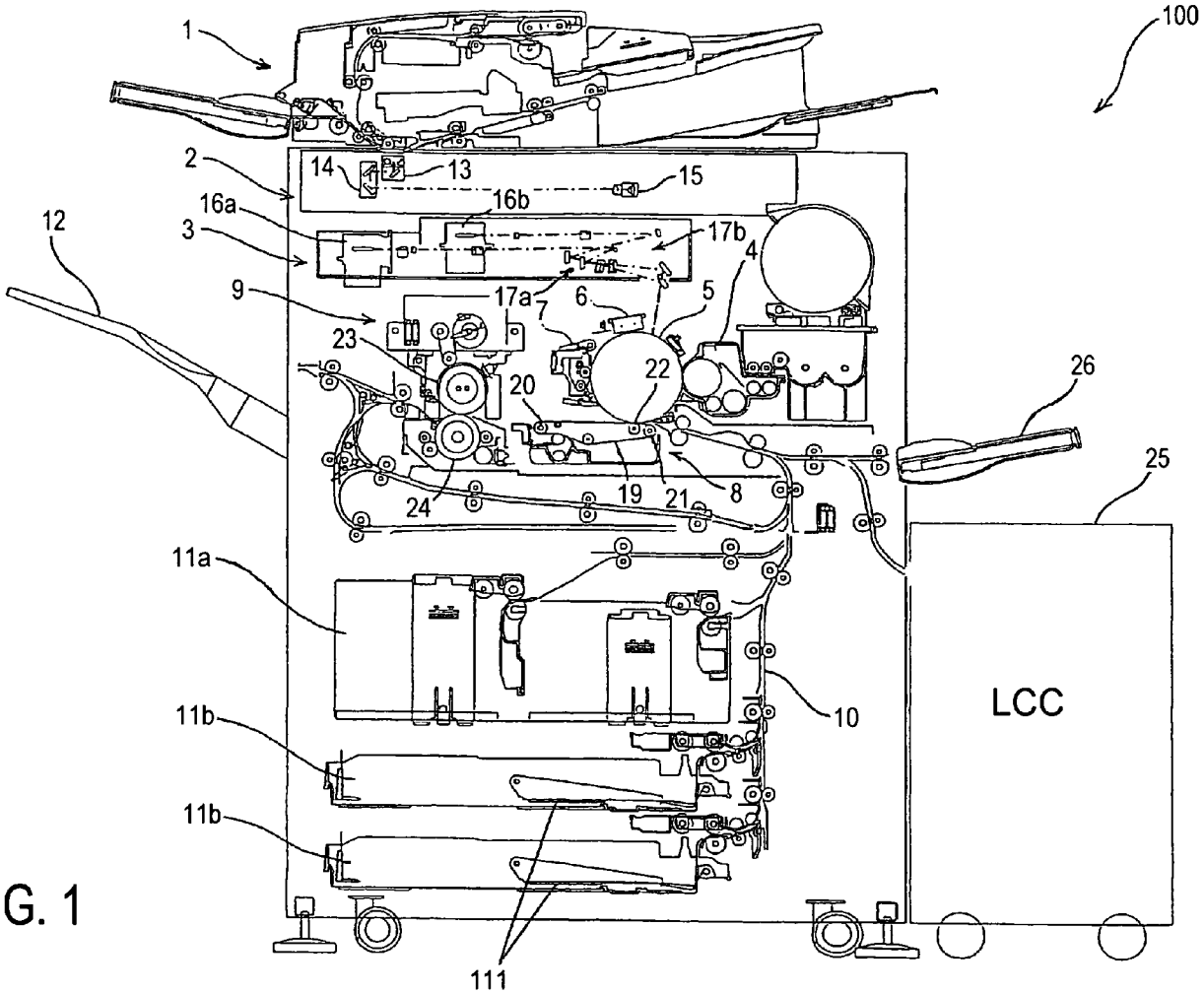
FIG. 1 is a schematic view showing an overall configuration of an image forming apparatus according to one embodiment of the present invention.

An image forming apparatus according to the present invention comprising: a main body having an image forming section; a sheet feed section having a sheet cassette that accommodates a recording sheet and can be drawn out and loaded to the main body; and a sheet misalignment preventing mechanism that intermittently comes in contact with an uppermost recording sheet in the sheet cassette so as to prevent misalignment of the recording sheet in a loading direction when the sheet cassette drawn out of the main body is reloaded.

The image forming apparatus according to the present invention includes at least the main body having the image forming section, the sheet feed section having the sheet cassette, and the sheet misalignment preventing mechanism as described above. It is needless to say that the image forming apparatus may additionally be provided with other peripheral functional sections to be described later that are generally provided to an image forming apparatus. It should be noted that, in the present invention, the recording sheet is not limited to paper, but includes all recording media on which a toner image can be printed.

In the present invention, the image forming section has a function of directly reading a document, a function of receiving document data (image data) from an external device (e.g., a personal computer), or both of these functions. The configuration of the image forming section is not particularly limited as long as it has a function of printing a toner image onto a recording sheet on the basis of the document data, and it may either perform a monochrome printing or color printing. One example of the configuration of the image forming section is one provided with a document reading section, an operation section, a photoconductor, a latent image forming section that forms a latent image onto a surface of the photoconductor on the basis of the document data read by the document reading section, a developing section that forms a toner image on the basis of the latent image on the surface of the photoconductor, a transfer section that transfers the toner image onto a recording sheet, a fixing section that fixes the transferred toner image on the recording sheet, and a cleaner section that removes residual toner on the photoconductor after the transfer. Instead of the document reading section, a document data receiving section may be provided, or the document reading section may have a document data receiving section that receives document data from an external device.

In the present invention, the sheet feed section is of a front-access type in which the sheet cassette can be drawn out toward the front (at the side of the operation section) of the main body and reloaded to the main body. The sheet feed section includes, in addition to the sheet cassette, a pickup roller that sends the recording sheet in the sheet cassette one by one to the image forming section, and a pickup roller driving mechanism that drives the pickup roller in rotating as well as vertically moving manner. The pickup roller and the pickup roller driving mechanism will be described later.

In the present invention, the configuration of the sheet misalignment preventing mechanism is not particularly limited, as long as it has a function of preventing the misalignment of the recording sheet in the loading direction by intermittently contacting the uppermost recording sheet in the sheet cassette, when the sheet cassette is reloaded after the recording sheets are replenished to the sheet cassette drawn out of the main body.

The pickup roller and the pickup roller driving mechanism can be used as a part of the configuration of the sheet misalignment preventing mechanism, and the sheet misalignment preventing mechanism can be configured to include a control section for controlling the pickup roller so as to repeatedly move up and down during the reloading operation of the sheet cassette. Alternatively, the pickup roller and the pickup roller driving mechanism may not be used, and a contact member (e.g., a rod with a round tip) that intermittently contacts the uppermost sheet and a vertically moving mechanism for moving the contact member up and down may be provided, whereby the control section controls the vertically moving mechanism and the vertical movement of the contact member. However, the former configuration is desirable in term of simplification of the apparatus structure and cost for the apparatus, since it includes a less number of components.

When the pickup roller and the pickup roller driving mechanism are also used as a part of the configuration of the sheet misalignment preventing mechanism, the pickup roller is formed into generally a half-round shape with a part of its circumference cut to be flat, whereby the rotational moment of the pickup roller can be utilized for the vertical movement.

In this case, the pickup roller driving mechanism is configured to include a drive roller that is arranged at the downstream side of the pickup roller in the sheet conveying direction and parallel to the axis of the pickup roller, a link member that rotatably links the drive roller and the pickup roller, a pulley and a belt that transmit a rotational force of the drive roller to the pickup roller, a spring member that urges the pickup roller upward about the axis of the drive roller, and a descending drive section that is turned ON at the time of conveying the sheet so as to descend the pickup roller about the axis of the drive roller and does not regulate the vertical movement of the pickup roller in its OFF state. By virtue of this configuration, when the sheet cassette is reloaded, the drive roller is rotated by a signal from the control section to rotate the pickup roller, whereby the pickup roller can repeatedly move up and down by the rotational moment of the pickup roller caused by the rotation thereof and the urging force of the spring member. The pickup roller mechanism itself has conventionally been known, and a special change in design is not necessary. A conventionally known mechanism using a solenoid or a cam that pivots the pickup roller downward in its ON state can be used as the descending drive section.

In the image forming apparatus according to the present invention, it is preferable that the sheet feed section further includes sheet ascending mechanism that lifts the recording sheet of at least the downstream side in the sheet conveying direction so as to raise the uppermost surface of the sheet to a sheet feeding point that is higher than the sheet cassette during the reloading operation of the sheet cassette, wherein the control section of the sheet misalignment preventing mechanism synchronously drives the pickup roller drive mechanism and the sheet ascending mechanism, and controls such that the pickup roller makes a vertical movement at an upward portion from the sheet feeding point. By virtue of this configuration, it can surely be prevented that the vertically moving pickup roller and the sheet cassette collide with each other during the loading operation of the sheet cassette. Further, since the pickup roller makes a vertical movement at the portion higher than the sheet feeding point, the pickup roller lightly comes into contact with the uppermost sheet intermittently to such an extent that the pickup roller does not damage the sheet, whereby the misalignment of the sheet in the loading direction can be prevented.

In this case, the sheet feed section may further include a loading detection section that detects a start of the reloading operation and a completion of the loading of the sheet cassette, wherein the control section may synchronously drive the pickup roller drive mechanism and the sheet ascending mechanism on the basis of a signal from the loading detection section and controls a start and a stop of the vertical movement of the pickup roller.

The image forming apparatus according to the present invention may have, as a peripheral functional section, an automatic document feeding section for feeding a document to the document reading section, a sheet discharge tray that receives a printed sheet from the image forming section, a manual feeding tray that feeds a desired sheet to the image forming section, a large-capacity sheet cassette provided separately from the sheet cassette for feeding a large amount of sheets to the image forming section, and the like.

Embodiments of the present invention will now be described with reference to the drawings. It is to be noted that the present invention is not limited to the embodiments described below.

(Overall Configuration and Operation of Image Forming Apparatus)

FIG. 1 is a schematic view showing an overall configuration of an image forming apparatus according to the present invention. This image forming apparatus 100 forms a monochrome image on a predetermined recording sheet (sheet) in accordance with externally transmitted image data. The image forming apparatus 100 includes a document conveying section 1 mounted on a main body, an image forming section provided at an upper part of the main body, a sheet feed section that is provided at a lower part of the main body, a large-capacity sheet cassette (LCC) 25 connected to a side face of the main body at the upstream side in the sheet conveying direction, a manual feeding tray 26 provided at a side face of the main body at the upstream side in the sheet conveying direction, and a sheet discharge tray 12 provided at a side face of the main body at the downstream side in the sheet conveying direction.

The image forming section is composed of an image reading section 2, an exposure unit 3, a developing device 4, a photoconductor 5, a charging device 6, a cleaner unit 7, a transfer unit 8, a fixing unit 9, etc. The sheet feed section is composed of sheet cassettes 11*a* and 11*b*, sheet conveying path 10, etc.

The image reading section 2 is mainly composed of a light source holder 13, mirror group 14, and a CCD 15. When the document fed from the document conveying section 1 is scanned, the image on the document is scanned with the light source holder 13 and the mirror group 14 in a stationary state.

When the document is conveyed from the document conveying section 1, light is irradiated to the document from a light source of the light source holder 13, and the optical path of the light reflected from the document is changed through the mirror group 14 to be focused on the CCD 15 so as to be converted into electrical image data.

The charging device 6 is for uniformly charging the surface of the photoconductor 5 to a predetermined potential. Although a charger-type charging device is employed in FIG. 1, a contact roller type charger or brush type charger may be employed.

As shown in FIG. 1, the exposure unit 3 is a system using a laser scanning unit (LSU) provided with a laser irradiating sections 16*a*, 16*b* and reflection mirrors 17*a*, 17*b*. In order to conduct a high-speed printing process, the exposure unit 3 employs a technique (two-beam method) of using a plurality of laser beams to reduce an increase in irradiation timing per laser device. Apart from the LSU, the exposure unit 3 may be, for example, an EL or LED writing head where light emitting elements are arranged in array.

The exposure unit 3 exposes the surface of the photoconductor 5 having been charged uniformly by the charging device 6 according to the image data inputted to the exposure unit 3 so as to form an electrostatic latent image on the surface of the photoconductor 5 according to the image data.

The image forming apparatus 100 includes a control section (not shown) for integrally controlling the overall apparatus.

The control section is composed of a CPU, a ROM that stores a control program executes by the CPU, a RAM that provides a work area to the CPU, a nonvolatile memory that holds control data, an input circuit to which a signal from detection mechanisms at each section of the image forming apparatus 100 is inputted, a driver circuit that drives an actuator and a motor for operating a driving mechanism of each section in the image forming apparatus 100, an output circuit for driving the laser irradiating sections 16*a*, 16*b*, etc. This control section is also operated at the time of reloading the sheet cassette which will be described later.

The developing device 4 develops the latent image formed on the photoconductor 5 with a black toner.

The cleaner unit 7 removes and collects residual toner remaining on the surface of the photoconductor 5 after the development and the image transfer.

The toner image developed on the photoconductor 5 is transferred onto the conveyed sheet at the transfer unit 8 (in the present apparatus, transfer belt unit) in such a manner that an electric field having a polarity opposite from that of the charges of the latent image is applied from the transfer unit 8. For example, when the latent image has charges of negative polarity, the applied polarity from the transfer unit 8 is positive.

In the transfer unit 8 of the present apparatus, a transfer belt 19 is disposed so as to be wound around a drive roller 20, a driven roller 21, and other rollers. The transfer belt 19 has a predetermined resistance (ranging from $1\times10^{9}$ to $1\times10^{13}$ Ωcm). Further, an elastic conductive roller 22 is disposed at a portion where the photoconductor 5 comes into contact with the transfer belt 19. The elastic conductive roller 22 can apply a transfer electric field with electrically conductive that is different from electric conductivities of the drive roller 20 and the driven roller 21. The elastic conductive roller 22 has elasticity, and this allows the photoconductor 5 and the transfer belt 19 to come into contact with each other at their surfaces, not in lines, having a given width (referred to as "transfer nip"). By this means, efficiency of the transfer onto a sheet being transported is enhanced.

Additionally, a charge removing roller is disposed on a backside of the transfer belt 19 downstream from a transfer area of the transfer belt 19. The charge removing roller removes the electric-field (charge) having been applied to the transported sheet in the transfer area to facilitate a shift to a subsequent process.

Besides, the transfer unit 8 includes a cleaning unit for cleaning toner contamination on the transfer belt 19 and a plurality of charge removing mechanisms for removing a charge of the transfer belt 19. It is to be noted that the plurality of charge removing mechanisms may employ a technique of grounding through a device or a technique of actively applying an electric-field having a polarity opposite from that of the transfer electric-field.

The unfixed toner image having been transferred onto the sheet by the transfer unit 8 is transported to the fixing unit 9, so that the unfixed toner is fused and fixed onto the sheet.

The fixing unit 9 includes a heat roller 23 and a pressure roller 24. Around the outer periphery of the heat roller 23, a sheet separation pawl, a roller surface temperature detecting member (thermistor), and a roller surface cleaning member are disposed. The heat roller 23 has a heat source at the inner periphery thereof. The heat source maintains the surface of the heat roller 23 at a predetermined temperature (preset fixing temperature: generally 160 to 200° C.).

Meanwhile, on both ends of the pressure roller 24, pressure members are disposed. The pressure members cause the pressure roller 24 to press the heat roller 23 at a predetermined pressure. Around the outer periphery of the pressure roller 24, a sheet separation pawl and a roller surface cleaning member are disposed as with the outer periphery of the heat roller 23.

At a portion where the heat roller 23 and the pressure roller 24 are in press-contact with each other (referred to as "fixing nip"), the unfixed toner on the sheet being transported is fixed onto the sheet through fusing at a surface temperature of the heat roller 23 and a press-contact function.

The sheet cassettes 11*a* and 11*b* are trays for stacking recording sheets to be used for the image formation and provided below the image forming section in the present apparatus as described above. The sheet cassettes 11*a* and 11*b* are vertically arranged in three stages. The image forming apparatus of the present embodiment aims at high speed print processing, so that each of the sheet cassettes can hold 500 to 1500 sheets of standard size. Arranged at the side face of the main body are the large-capacity sheet cassette 25 that can hold a large amount of sheets of different types, and the manual feeding tray 26 mainly used in e.g., printing on sheets of irregular size.

The sheet discharge tray 12 is disposed at a side surface of the main body that is opposite to the surface thereof on which the manual feeding tray 26 is disposed. Optionally, the sheet discharge tray 12 may be replaced with a post-processing device (e.g. stapler and hole-punching) for the discharged sheets or a multi-stage sheet discharge tray.

(Configuration and Operation of Sheet Feed Section)

The sheet feed section has the sheet cassettes 11*a* and 11*b* vertically arranged in three stages as described above.

The upper sheet cassette 11*a* has two spaces for storing sheets. A pickup roller, a separation roller and a feed roller are provided integrally with the housing of the sheet cassette at the downstream side of the spaces in the sheet conveying direction. The sheet cassette 11*a* has, at a bottom part of each storing space, a sheet placing plate on which recording sheets are placed, and an ascending mechanism that independently raises each placing plate, so as to raise the uppermost surface of the sheet to the sheet feeding point that is the position of the pickup roller.

The middle and lower sheet cassettes 11*b* and 11*b*, which have the same configuration each other, have a capacity smaller than that of the upper sheet cassette 11*a*. A sheet placing plate 111 on which recording sheets are placed is provided at a bottom part of each of the sheet cassettes 11*b* and 11*b* at the downstream side in the sheet conveying direction. Further, a side plate 112 for regulating the size of the sheet is provided to the sheet cassettes 11*b* and 11*b* (see FIG. 4). The side plate 112 is set to have the same height as or slightly lower than the height of the side edge portion (front and rear) of the sheet cassette 11*b*. The placing plate 111 is pivotably mounted at generally a middle position of the sheet cassette 11*b* in the sheet conveying direction by a shaft member extending in a direction orthogonal to the sheet conveying direction. The sheet cassette 11*b* further has a pivot member and a shaft section that lift up the downstream end portion of the placing plate 111 to an end portion at the downstream side in the sheet conveying direction, and the sheet feed section has at the side of the main body a driving source 111*a* (see FIG. 6) that can be engaged or disengaged with the shaft section so as to pivot the shaft section at a predetermined rate. Therefore, the pivot member pivots upward by the driving source 111*a* via the shaft section, by which the downstream end portion of the placing plate 111 pivots upward, whereby the stack of sheets moves up to bring the uppermost surface thereof to the sheet feeding point.

Figure 2:
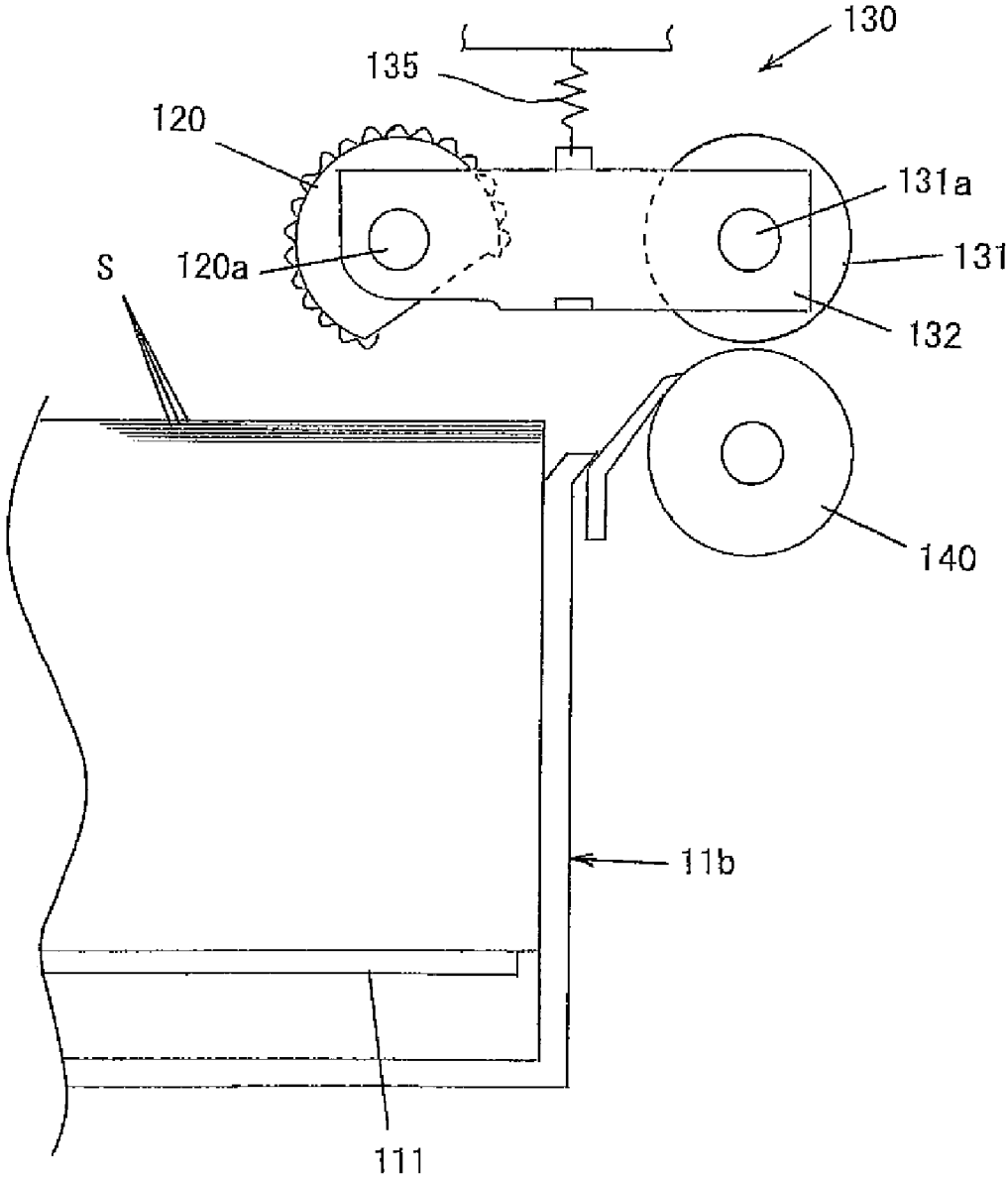
FIG. 2 is a side view for explaining a schematic configuration of a pickup roller and its driving mechanism in the image forming apparatus shown in FIG. 1.
Figure 3:
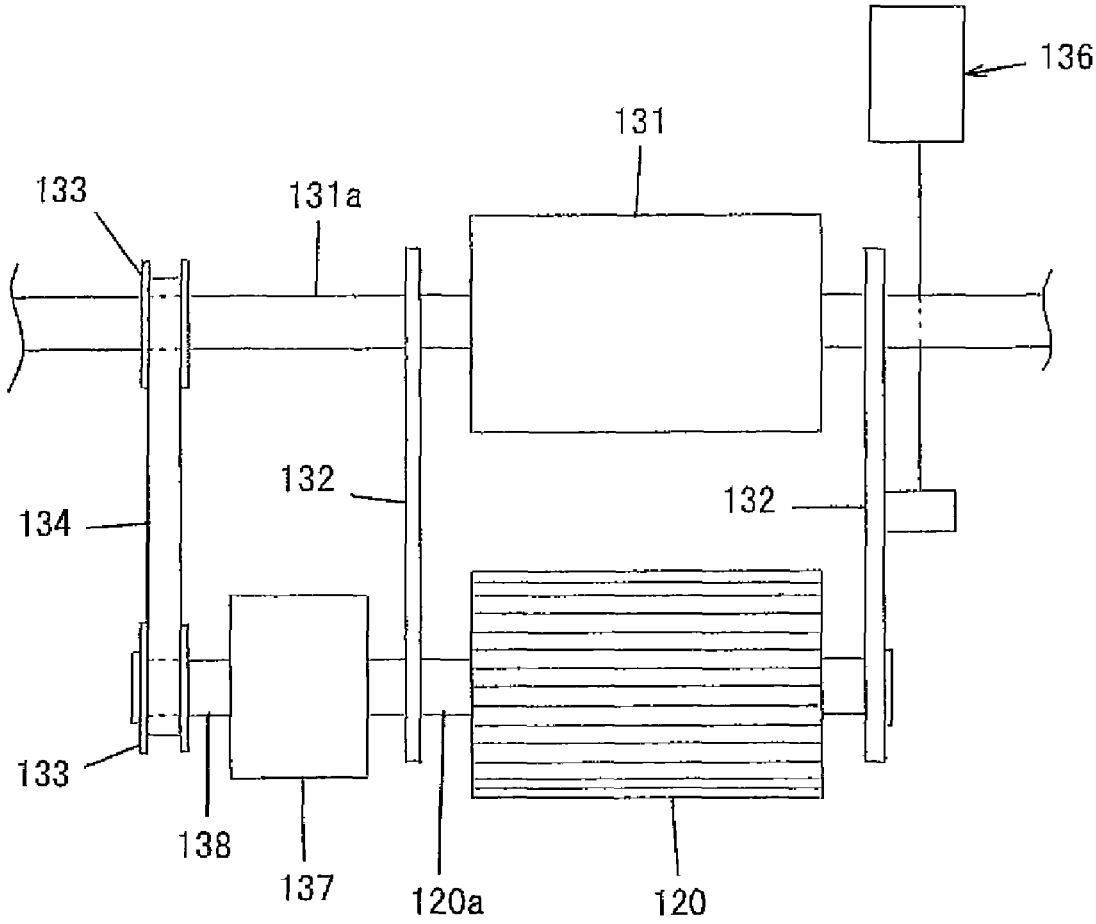
FIG. 3 is a plan view for explaining the schematic configuration of the pickup roller and its driving mechanism in FIG. 2.

As shown in FIGS. 1 to 3, the sheet feed section is provided with a pickup roller driving section 130 including a pickup roller 120 and a separation roller 131, and a sheet feed roller 140 above the sheet cassettes 11*b* at the downstream side in the sheet conveying direction. In FIG. 2, reference symbol S denotes a recording sheet.

The pickup roller 120 is formed into generally a half-round shape (a shape rather close to a circle than a semi-circle) when viewed from an axial direction, formed by cutting a part of its circumference to be flat, and a band-like rubber member having a corrugated surface is adhered onto the outer peripheral surface of its arc portion.

The pickup roller driving mechanism 130 has the separation roller (drive roller) 131 that is arranged at the downstream side of the pickup roller 120 in the sheet conveying direction and parallel to the axis of the pickup roller 120, a link member 132 that rotatably links the separation roller 131 and the pickup roller 120 through shafts 120*a* and 131*a*, a pair of pulleys 133 and a belt 134 that transmit rotational force of the separation roller 131 to the pickup roller 120, a spring (spring member) 135 that urges the pickup roller 120 upward about the axis of the separation roller 131, a descending drive section 136 that is turned ON during the conveyance of the sheet to descend the pickup roller 120 about the axis of the separation roller 131 and does not regulate the vertical movement of the pickup roller 120 in its OFF state, and a motor 130*a* (see FIG. 6) that drives and rotates the shaft 131*a* so as to rotate the separation roller 131 and the pickup roller 120. The descending drive section 136 can be composed of, e.g., a solenoid and a link member that links the shaft of the solenoid and the link member 132.

In the present embodiment, an electromagnetic clutch 137 and another shaft 138 are provided at one end of the shaft 120*a* of the pickup roller 120. The pair of pulleys 133 are attached to the shaft 138 and the shaft 131*a* of the separation roller 131. The electromagnetic clutch 137 links the shaft 120*a* of the pickup roller 120 and the shaft 138 in its ON state, and releases the link between the shaft 120*a* and the shaft 138 in its OFF state. The electromagnetic clutch 137 may be omitted, and one of the pulleys 133 may be directly attached to the shaft 120*a* of the pickup roller 120.

Provided at the sheet feed section above each of the sheet cassettes 11*a* and 11*b* that are attached to the main body are a known sheet height detecting section 150 for detecting the height of the uppermost surface of the sheets in each of the sheet cassettes 11*a* and 11*b* and a loading detection section 151 for detecting that the middle and lower cassettes 11*b*, which have been drawn out of the main body, are reloaded. The loading detection section 151 is provided at a position where a start and completion of the reloading operation of the sheet cassette 11*b* can be detected. For example, an optical sensor or a mechanical sensor is arranged on the main body at the near side in the drawing direction of the sheet cassette, whereby the operation (start of reloading, completion of loading) of the sheet cassette 11*b* can be detected from a detection state (ON-OFF, etc.) of the sensor.

Figure 6:
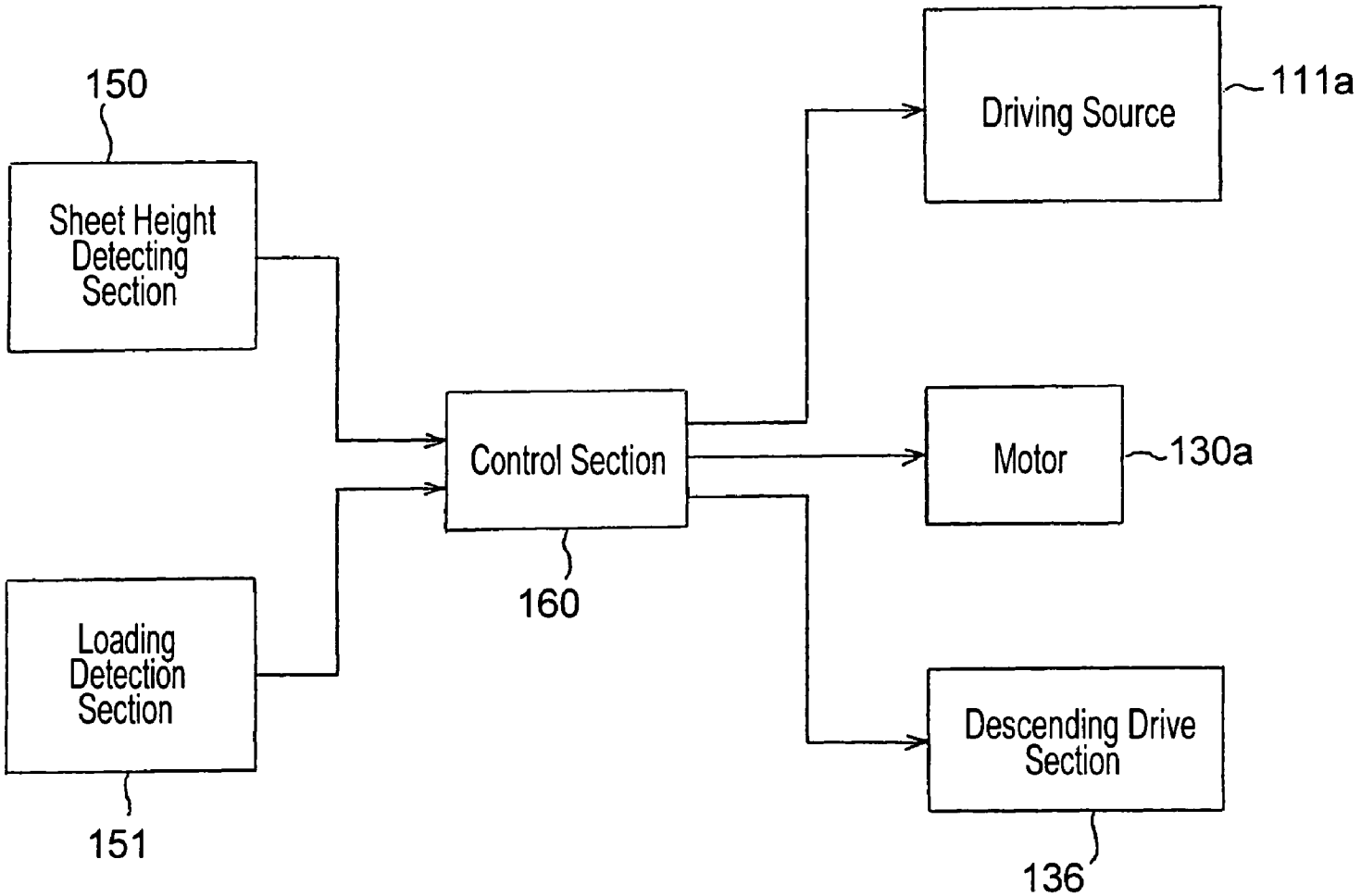
FIG. 6 is a block diagram showing a control system in the image forming apparatus in FIG. 1.
Figure 7A:
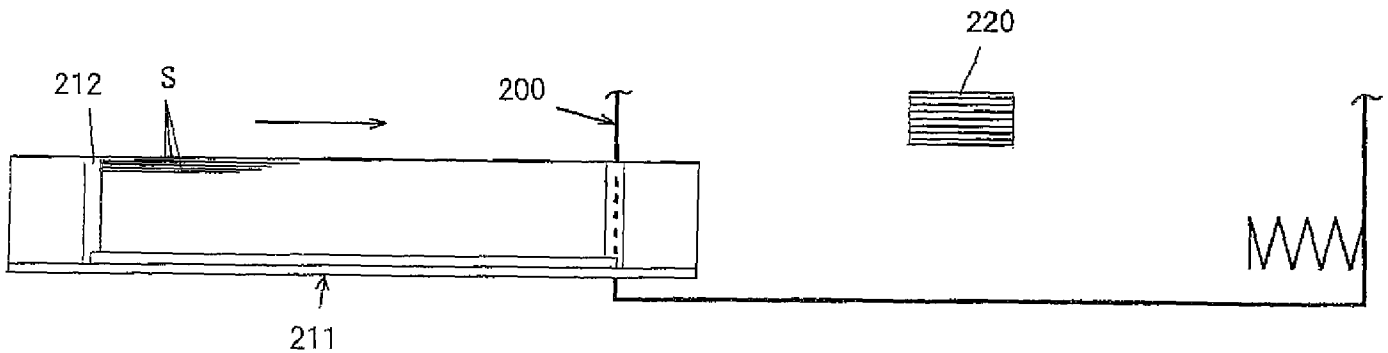
FIG. 7(a) (Prior Art)
FIG. 7 is a view for explaining a reloading state of a sheet cassette in a conventional image forming apparatus.
Figure 7B:
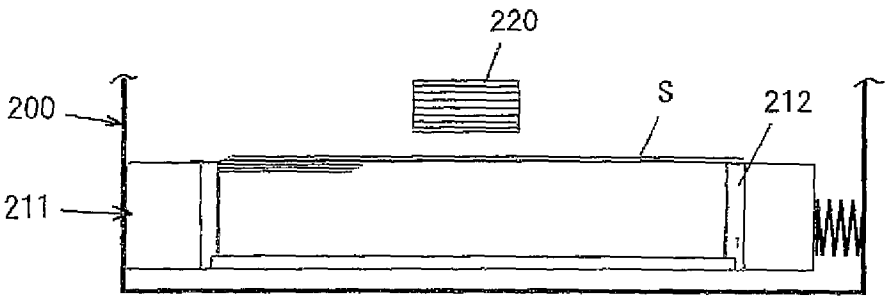
FIG. 7(b) (Prior Art)

As shown in FIG. 6, the sheet height detecting section 150 and the loading detection section 151 transmit a detection signal to the aforementioned control section 160. The control section 160 transmits a control signal to the driving source 111*a* for lifting the placing plates of the sheet cassettes 11*a* and 11*b* and the motor 130*a* of the pickup roller driving section 130.

Subsequently, the operations of the middle and lower sheet cassettes of the thus configured image forming apparatus when they are reloaded will be described with reference to FIGS. 2 to 6.

Recording sheets are replenished to the middle or lower sheet cassette drawn out of the main body. In this case, the sheets are accommodated to the top height of the side plate of the sheet cassette.

Figures 4A, 4B, 4C:
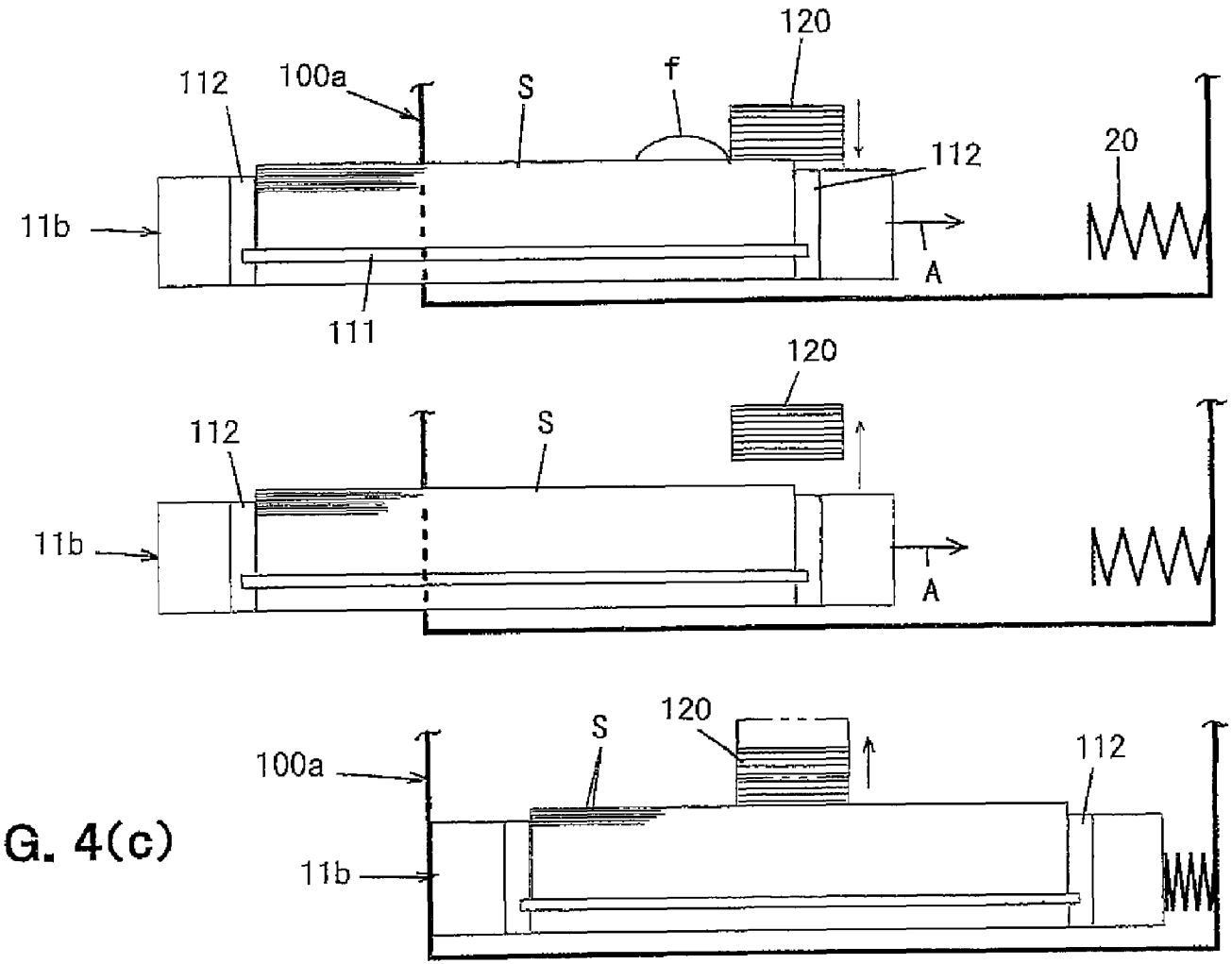
FIG. 4 is a view for explaining a reloading state of the sheet cassette in the image forming apparatus in FIG. 1.

When the sheet cassette 11*b* is then inserted into the main body 100*a* to start the reloading as shown in FIG. 4A, a loading start signal is transmitted to the control section 160 from the loading detection section 151 (see FIG. 6). Then, a control signal is transmitted to the driving source 111*a* for lifting the placing plate and the motor 130*a* of the pickup roller driving mechanism 130 from the control section 160, whereby the driving source 111*a* and the motor 130*a* are synchronously driven. Consequently, the placing plate 111 in the sheet cassette 11*b* moves up to raise the uppermost recording sheet S to the sheet feeding point, and simultaneously, the pickup roller 120 starts rotating and making the vertical movement.

FIG. 5 is a view for explaining the state in which the pickup roller 120 rotates and vertically moves. Upon reloading the sheet cassette 11*b*, the descending drive section 136 (see FIG. 3) of the pickup roller drive mechanism 130 is in its OFF state, so that the vertical movement of the pickup roller 120 is not regulated by the descending drive section 136. Therefore, the pickup roller 120 vertically pivots about the shaft 131*a* due to the rotational moment generated by the rotation of the generally half-round pickup roller 120 and the upward urging force of the spring 135.

Figure 5A:
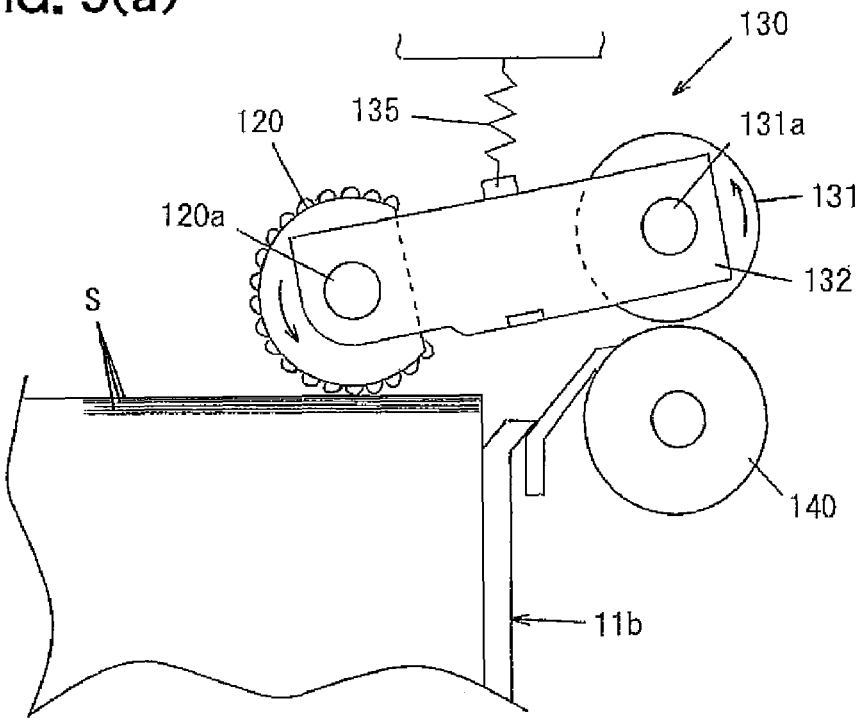
FIG. 5 is a view for explaining a vertical movement of the pickup roller in the image forming apparatus in FIG. 1.

Specifically, since downward centrifugal force at the time when the middle part of the arc of the pickup roller 120 reaches the upstream side in the sheet conveying direction exceeds the urging force of the spring 135, the pickup roller 120 pivots downward with the link member 132 so as to lightly come into contact with the uppermost sheet surface instantaneously (see FIG. 5A). Thereafter, when the middle part of the arc of the pickup roller 120 reaches the downstream side in the sheet conveying direction, the centrifugal force directs upward, whereby the pickup roller 120 pivots upward (see FIG. 5B). As described above, the pickup roller 120 repeats the vertical movement while rotating. Since the rotation number of the motor 130*a* is controlled by the control section 160, the rotational moment of the pickup roller 120 is controlled, whereby the lowermost position of the pickup roller 120 is set to the sheet feeding point (the uppermost surface of the recording sheet S).

Figure 5B:
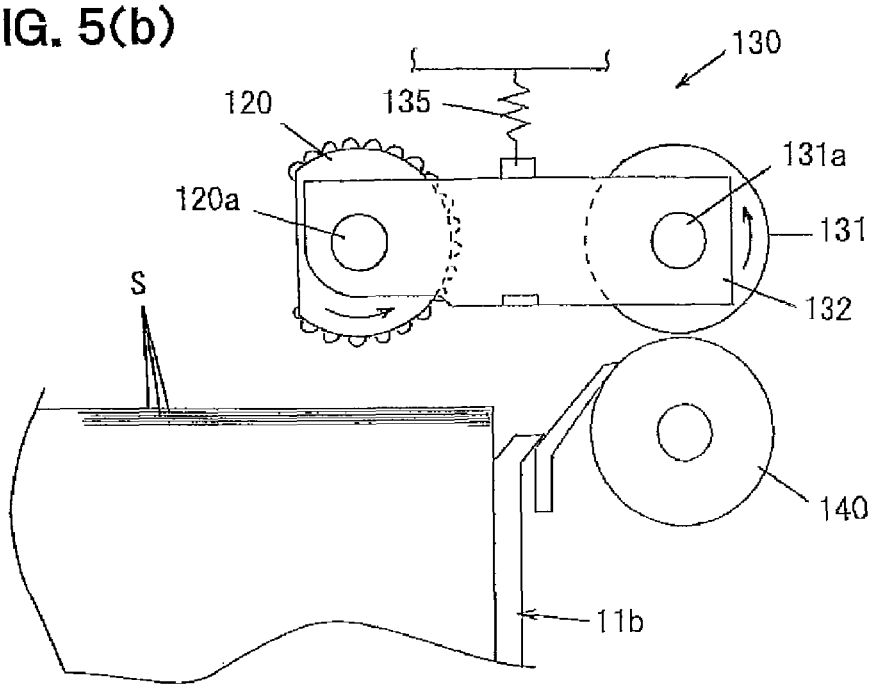

FIG. 4A shows the state in which the pickup roller 120 pivots downward to be in contact with the uppermost surface of the sheet as in the case of FIG. 5A. Since the sheet cassette 11*b* moves in the loading direction (in the direction of arrow A), there may be the case where a deflection f is produced in the uppermost sheet S that comes into contact with the pickup roller 120. However, since the pickup roller 120 instantaneously moves up as shown in FIG. 4B and FIG. 5B, the sheet S returns to be flat and the deflection is eliminated, when the pickup roller 120 is apart from the uppermost sheet S. In this manner, the pickup roller 120 comes into contact with the uppermost sheet S three to five times during the period from the start of the reloading of the sheet cassette 11*b* to the completion of the reloading shown in FIG. 4C, when the sheet size accommodated in the sheet cassette is A4 (210 mm×299 mm) and short sides of the sheet is located in the sheet conveying direction, for example. Owing to the instantaneous repeated contact (light strike) described above, the positional misalignment of the sheet S above the side plate 112 in the loading direction is prevented. In FIG. 4, reference numeral 20 denotes a cushion member for relieving an impact upon the completion of the loading of the sheet cassette 11*b*.

After the loading of the sheet cassette 11*b* is completed, a loading completion signal is transmitted from the loading detection section 151 (see FIG. 6) to the control section 160, whereby the control signal is transmitted from the control section 160 to the motor 130*a*. Accordingly, the motor 130*a* is stopped to stop the rotation and vertical movement of the pickup roller 120. After the rotation of the pickup roller 120 is stopped, the pickup roller 120 waits at an upward stand-by position by the spring 135 (see FIG. 2). The control signal is also transmitted from the control section 160 to the driving source 111*a*, whereby the driving source 111*a* comes into an OFF state. Accordingly, the placing plate 111 is lowered to the lowermost position, so that the stack of sheets descends.

When a printing process is started, a sheet height signal is transmitted from the sheet height detecting section 150 to the control section 160, whereby the control signal is transmitted from the control section 160 to the driving source 111*a*. Accordingly, the uppermost sheet ascends to the sheet feeding point as described above. Further, the control signal is transmitted from the control section 160 to the descending drive section 136 and the motor 130*a*, whereby the pickup roller 120 descends to the sheet feeding point and the pickup roller 120 rotates to feed the uppermost sheet S to the image forming section.

When a plurality of sheets are continuously printed by the printing process, the electromagnetic clutch 137 is turned OFF to stop the rotation of the pickup roller 120 after one sheet is fed, and the electromagnetic clutch 137 is turned ON to rotate the pickup roller 120 at the timing of feeding a next sheet, in order to provide a predetermined sheet space. Thus, a sheet is conveyed one by one. In the configuration in which the electromagnetic clutch is omitted, the pickup roller that keeps on rotating is caused to make a vertical movement so as to provide a sheet space.

The present invention is applicable to an electrophotographic image forming apparatus such as a copying machine, printer, and the like.

What is claimed is:

1. An image forming apparatus comprising:

a main body having an image forming section;

a sheet feed section having a sheet cassette that accommodates a recording sheet and can be drawn out and loaded to the main body; and a sheet misalignment preventing mechanism that intermittently comes into contact with an uppermost recording sheet in the sheet cassette so as to prevent misalignment of the recording sheet in a loading direction when the sheet cassette drawn out of the main body is reloaded, wherein the sheet feed section includes the sheet cassette, a pickup roller that sends the recording sheet in the sheet cassette one by one to the image forming section and a pickup roller driving mechanism that drives the pickup roller in rotating as well as vertically moving manner;

the pickup roller and the pickup roller driving mechanism are used as a part of the configuration of the sheet misalignment preventing mechanism, and the sheet misalignment preventing mechanism includes a control section for controlling the pickup roller so as to repeatedly move up and down during the reloading operation of the sheet cassette;

the pickup roller is formed into generally a half-round shape with a portion of its circumference cut to be flat;

the pickup roller driving mechanism includes a drive roller that is arranged at the downstream side of the pickup roller in the sheet conveying direction and parallel to an axis of the pickup roller, a link member that rotatably links the drive roller and the pickup roller, a pulley and a belt that transmit the rotational force of the drive roller to the pickup roller, a spring member that urges the pickup roller upward about the axis of the drive roller, and a descending drive section that is turned ON during the conveyance of the sheet to descend the pickup roller about the axis of the drive roller and does not regulate the vertical movement of the pickup roller in its OFF state; and the drive roller is rotated by a signal from the control section to rotate the pickup roller, and the pickup roller repeatedly moves up and down by rotational moment of the pickup roller caused by the rotation thereof and urging force of the spring member, when the sheet cassette is reloaded.

2. The image forming apparatus according to claim 1, wherein the sheet feed section further includes a sheet ascending mechanism that lifts the recording sheet of at least the downstream side in the sheet conveying direction so as to raise the uppermost surface of the sheet to a sheet feeding point during the reloading operation of the sheet cassette; and the control section synchronously drives the pickup roller drive mechanism and the sheet ascending mechanism and controls such that the pickup roller makes a vertical movement at an upward portion from the sheet feeding point.

3. The image forming apparatus according to claim 2, wherein the sheet feed section further includes a loading detection section that detects a start of the reloading operation and a completion of the loading of the sheet cassette; and the control section synchronously drives the pickup roller drive mechanism and the sheet ascending mechanism on the basis of a signal from the loading detection section and controls a start and a stop of the vertical movement of the pickup roller.

* * * * *